US008517287B2

(12) United States Patent
Zhou

(10) Patent No.: US 8,517,287 B2
(45) Date of Patent: Aug. 27, 2013

(54) WATER SAVING SHOWER NOZZLE

(76) Inventor: Huasong Zhou, Fujian (CN)

( * ) Notice: Subject to any disclaimer, the term of this patent is extended or adjusted under 35 U.S.C. 154(b) by 420 days.

(21) Appl. No.: 12/138,699

(22) Filed: Jun. 13, 2008

(65) Prior Publication Data

US 2009/0308955 A1 Dec. 17, 2009

(51) Int. Cl.
*B05B 1/34* (2006.01)

(52) U.S. Cl.
USPC ..... 239/383; 239/498

(58) Field of Classification Search
USPC ..... 239/383, 461, 463, 477, 482, 483, 239/490–494, 498, 548, 382, 522, 562
See application file for complete search history.

(56) References Cited

U.S. PATENT DOCUMENTS 1,976,062 A * 10/1934 Estep ..... 239/403
2,069,733 A * 2/1937 Zinkil ..... 239/403
2,878,066 A * 3/1959 Erwin ..... 239/381
4,101,075 A * 7/1978 Heitzman ..... 239/101
4,398,669 A * 8/1983 Fienhold ..... 239/447
4,618,100 A * 10/1986 White et al. ..... 239/440
4,838,486 A * 6/1989 Finkbeiner ..... 239/117
5,143,298 A * 9/1992 Prokopoff ..... 239/494
5,215,258 A * 6/1993 Jursich ..... 239/394
5,294,054 A * 3/1994 Benedict et al. ..... 239/222.15
6,412,711 B1 * 7/2002 Fan ..... 239/446
6,715,699 B1 * 4/2004 Greenberg et al. ..... 239/394

* cited by examiner

*Primary Examiner* — Davis Hwu

(57) ABSTRACT

The present invention pertains to a water reducing shower nozzle assembly having a main body with a cavity defined therein, and the cavity includes a fan-shaped cavity and a funnel-shaped cavity. A plurality of jets are synchronously driven by a quasi-blade device inside the fan-shaped cavity, and the funnel-shaped cavity comprises an outlet disposed thereon. The jets, being driven by the quasi-blade device allow less water into the outlet to save water; due to jets rotating periodically and the specific configuration of the funnel-shaped cavity, water can be formed in dense water drops and sprayed out from the outlet in multiple directions, thereby maintaining the same water power as conventional showering nozzles without a water reducer with synchronously rotated jets.

2 Claims, 3 Drawing Sheets

WATER SAVING SHOWER NOZZLE

BACKGROUND OF THE INVENTION

1. Field of the Invention

The present invention relates to bath equipments, particularly, to a water reducing shower nozzle assembly with a water reducer, accompanied by rotated jets driven by a quasi-blade device, for reducing water and at the same time maintaining a strong water jet power.

2. Description of the Related Art

Typically, the shower equipment in the market commonly has a plurality of outlets disposed on the shower nozzle for incessantly outputting water, but the above design has the disadvantage of wasting too much water. For reducing the water flow, the American market hence requests the nozzle to add water-saving plates or reduce the numbers of outlets. Nevertheless, the increment of the water-saving-plate or the reduction of the numbers of outlets may reduce the water flow at the expense of reducing jetting power of water flow. Therefore, the above shower equipments are still unable to output strong power of water by inputting less water, thus leaving room for further improvements.

SUMMARY OF THE INVENTION

The object of the present invention is to provide a water reducing shower nozzle assembly which reduces the volume of water flow and at the same time, maintains the same jetting power of water flow like ordinary shower nozzles without a water reducer device.

The water reducing shower nozzle assembly in accordance with the present invention mainly provides with a main body where a cavity is defined, and the cavity is divided by a fan-shaped cavity and a funnel-shaped cavity with an outlet formed on the bottom thereof. Particularly, the fan-shaped cavity has a quasi-blade device and a plurality of jets disposed under the quasi-blade device for being rotated thereby. By means of the above configuration, the quasi-blade device drives part of the jets to be in a high speed rotation so that the jets carries less water than otherwise into the funnel-shaped cavity, hence saving water; further, the funnel-shaped cavity assists in slantingly outputting water and accompanies the periodic rotations of jets; water thus is sprayed from the outlet in multiple directions and forms dense water drops, thereby achieving a strong shower power by reducing the water flow.

The advantages of the present invention over the known prior arts will become more apparent to those of ordinary skilled in the art by the following descriptions with drawings.

DETAILED DESCRIPTION OF THE PREFERRED EMBODIMENTS

Figure 1:
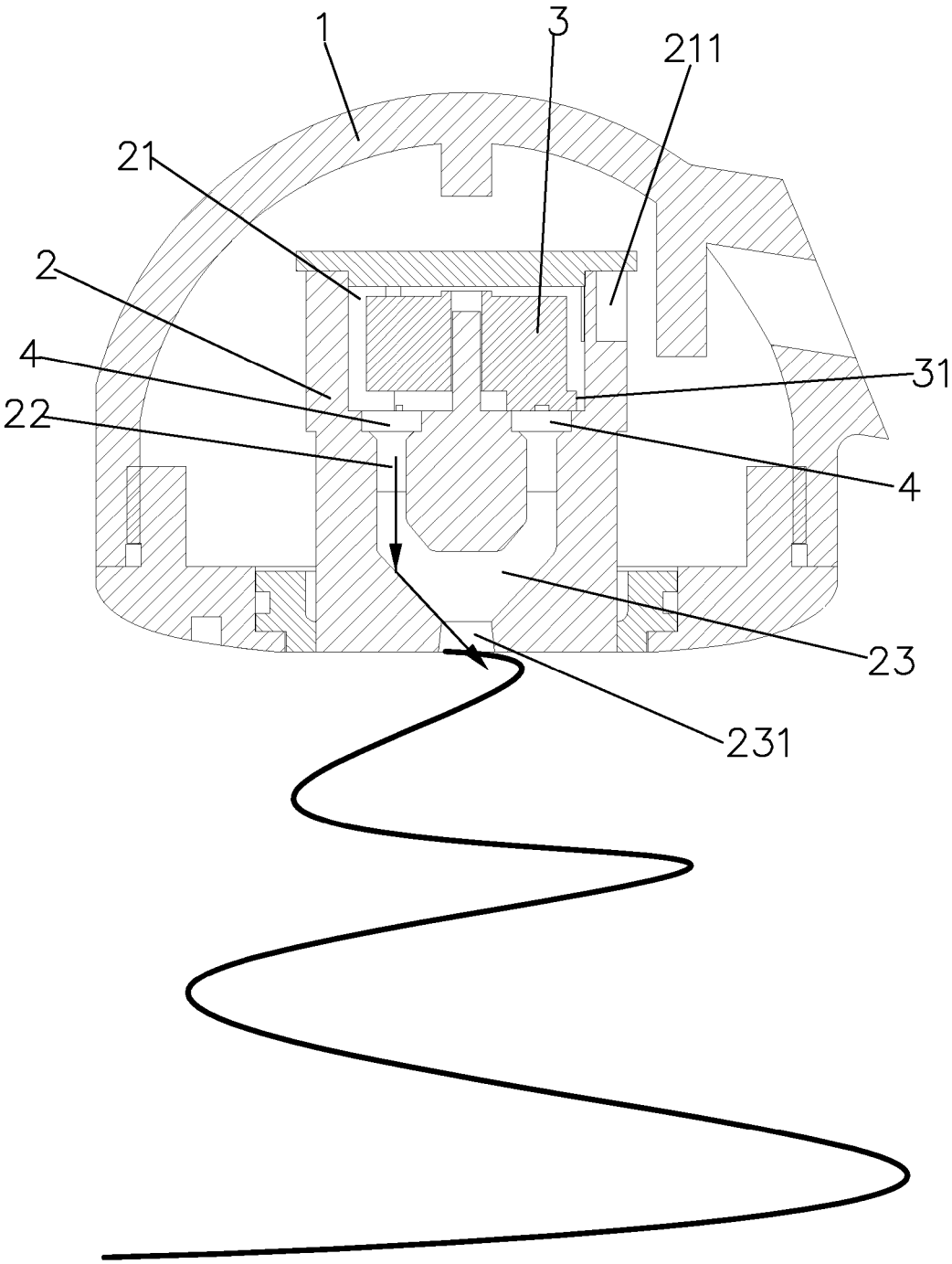
FIG. 1 is a cross-section view showing one preferred embodiment of the present invention.

Before the present invention is described in greater details, it should be noted that the like elements are denoted by the same reference numerals throughout the disclosure.

Figure 2:
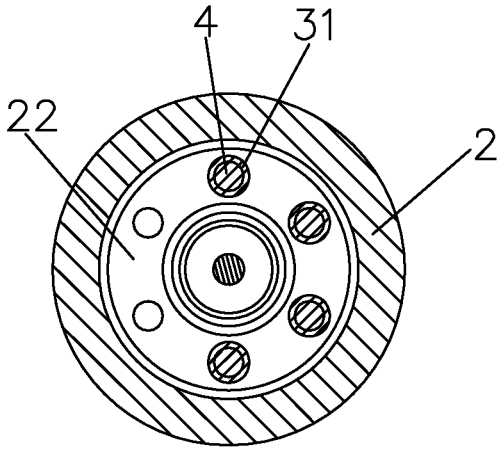
FIG. 2 is a cross-section view showing the portion of A-A in FIG. 1.

Referring to FIG. 1, one preferred embodiment of the present invention comprises a main body 1 and a cavity 2 defined therein, and the cavity 2 includes a fan-shaped cavity 21 formed on the top thereof, a funnel-shaped cavity 23 formed on the bottom thereof, and a ring-shaped cavity 22 disposed between the two cavities 2 and 23; wherein, the fan-shaped cavity 21 has a quasi-blade device 3 located therein and an inlet 211 (for instance formed in a slant state) disposed by the quasi-blade device 3. Further a plurality of ribs 31 are mounted under the quasi-blade device 3 and face the ring-shaped cavity 22 for operating with device 3; further, a plurality of jets 4 are disposed above the ring-shaped cavity 22, so that the ribs 31, as a water flow reducer, block at least one jet 4 (as illustrated in FIG. 2). Additionally, the funnel-shaped cavity 23 has an outlet 231 defined at its distal end for ultimately spraying the water out of the nozzle.

Referring to FIGS. 1 and 2, while in operation, the water initially comes into the main body 1, and passes through the slope inlet 211 and thence hits the quasi-blade device 3 to generate a high speed rotation. In this manner, the ribs 31 on the quasi-blade device 3 periodically block part of the jets 4 (shown in FIG. 2), so that the unblocked jets 4 can instantaneously output less water into the ring-shaped cavity 22 for reducing the water flow, and the jets 4 also rotate periodically. When the water subsequently goes through the ring-shaped cavity 22 and arrives in the funnel-shaped cavity 23, the water thence can be slantingly output from the outlet 231 (as arrowed in FIG. 1) to form highly densed water drops and finally be sprayed out of the body 1 in multiple directions. Therefore the present invention not only saves the water but is able to maintain the same powerful water flow just like those showers lacking a water reducer.

Figure 3:
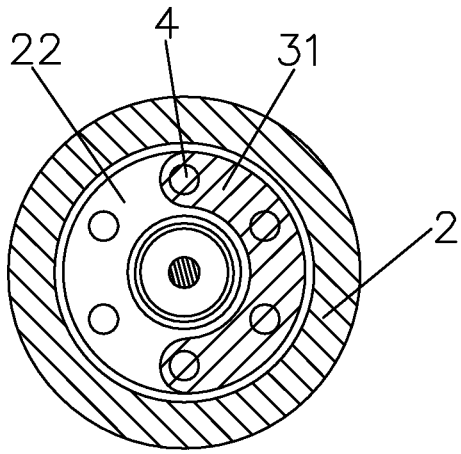
FIG. 3 is a cross-section view showing another preferred embodiment of the present invention.
Figure 4:
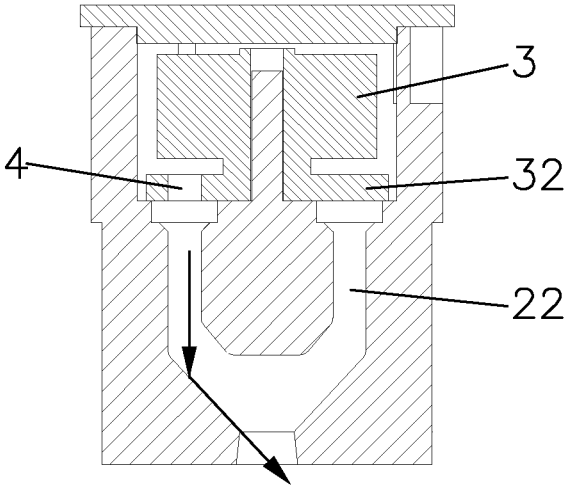
FIG. 4 is a cross-section view showing the other preferred embodiment of the present invention.

Referring to FIG. 3, another preferred embodiment of the present invention still comprises the similar configurations and operations like the previous embodiment. The only difference is that a fanned rib 31 is mounted on the quasi-blade device 3 and periodically blocks more than one of the jets 4 at the same time; furthermore, the quasi-blade device 3 can additionally have a rotary plate 32 (as shown in the FIG. 4) to be located thereunder for aiding in driving the jets 4, whereby the jets 4 are formed in a periodical rotation under the high speed driving of the device 3 and the fanned rib 31.

To sum up, the present invention takes advantages of the jets synchronically driven by the quasi-blade device 3 in the fan-shaped cavity 21 and only one outlet 231 disposed on the funnel-shaped cavity 23, whereby the jets 4 performing in a periodical rotation aid in conducting less water into the ring-shaped cavity 22 for saving the water. Furthermore, the configuration of the funnel-shaped cavity 23 facilitates to spray the water out of the outlet 231 in multiple directions, thereby achieving a strong water power as conventional showering nozzle without a water reducer.

While we have shown and described the embodiment in accordance with the present invention, it should be clear to those skilled in the art that further embodiments may be made without departing from the scope of the present invention.

I claim:

1. A water reducing shower nozzle assembly, comprising a main body, and a cavity with a top and a bottom, defined inside said main body, including i) a fan-shaped cavity, formed on the top thereof, and ii) a funnel-shaped cavity, formed on the bottom thereof, including an outlet defined at a distal end thereof for outputting water slantingly from said nozzle assembly, wherein said fan-shaped cavity includes i.a) a quasi-blade device, driven to rotate periodically by incoming water of said nozzle assembly, further including a water-reducer coordinating with said quasi-blade for reducing water flow out of said nozzle assembly, i.b) an inlet, disposed nearby said quasi-blade device, and i.c) a plurality of jets, disposed under said quasi-blade device and facing said funnel-shaped cavity for synchronously rotated with said quasi-blade device, wherein said water reducer includes:

a plurality of ribs, disposed under said quasi-blade device, for blocking water flow from one or more said jets.

2. A water reducing shower nozzle assembly, comprising a main body, and a cavity with a top and a bottom, defined inside said main body, including i) a fan-shaped cavity, formed on the top thereof, and ii) a funnel-shaped cavity, formed on the bottom thereof, including an outlet defined at a distal end thereof for outputting water slantingly from said nozzle assembly, wherein said fan-shaped cavity includes i.a) a quasi-blade device, driven to rotate periodically by incoming water of said nozzle assembly, further including a water-reducer coordinating with said quasi-blade for reducing water flow out of said nozzle assembly, i.b) an inlet, disposed nearby said quasi-blade device, and i.c) a plurality of jets, disposed under said quasi-blade device and facing said funnel-shaped cavity for synchronously rotated with said quasi-blade device, wherein a ring-shaped cavity is disposed between said fan-shaped cavity and said funnel-shaped cavity, and said jets are mounted above said ring-shaped cavity, and said water-reducer includes a plurality of ribs, disposed under said quasi-blade device, for blocking water flow from one or more said jets.

* * * * *